US006810803B2

(12) United States Patent
Hashimoto et al.

(10) Patent No.: US 6,810,803 B2
(45) Date of Patent: Nov. 2, 2004

(54) STENCIL PRINTING INK CONTAINER

(75) Inventors: Hirohide Hashimoto, Amimachi (JP); Masakatsu Arai, Amamachi (JP); Kenichi Oshio, Amimachi (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 10/429,880

(22) Filed: May 6, 2003

(65) Prior Publication Data

US 2003/0209157 A1 Nov. 13, 2003

(30) Foreign Application Priority Data

May 8, 2002 (JP) ..... 2002-132507
Apr. 2, 2003 (JP) ..... 2003-098903

(51) Int. Cl.[7] ..... B41L 13/00; B41L 27/00; B41L 31/16

(52) U.S. Cl. ..... 101/335; 101/116; 101/119; 101/364; 101/366; 222/386

(58) Field of Search ..... 101/116, 119, 101/335, 364, 366, 35, 114; 222/145.7, 386

(56) References Cited

U.S. PATENT DOCUMENTS 6,067,906 A * 5/2000 Ryan et al. ..... 101/335
2001/0003953 A1 * 6/2001 Wakayama et al. ..... 101/119
2001/0042468 A1 * 11/2001 Inoue et al. ..... 101/335

FOREIGN PATENT DOCUMENTS

JP 2000-272097 A 10/2000
JP 2000-318288 A 11/2000

* cited by examiner

*Primary Examiner*—Andrew H. Hirshfeld
*Assistant Examiner*—Marissa Ferguson
(74) *Attorney, Agent, or Firm*—Nixon Peabody LLP; Donald R. Studebaker

(57) ABSTRACT

A stencil printing ink container comprises a cylinder, an area of one end of the cylinder, which area is other than an ink discharge opening section, being closed with an end wall, the other end of the cylinder being open, and a piston, which undergoes a sliding movement in an axial direction of the cylinder and along its inner circumferential surface. The ink container is filled with ink having a viscosity of at most 7.5 Pa·s with respect to a shear rate of 100 $sec^{-1}$ and at 23° C. and satisfies a specific relationship among an inside radius of the cylinder, an inside radius of the ink discharge opening section, a length of the ink discharge opening section, a weight of the ink filled in the ink container, a sliding movement starting load of the piston, and the viscosity of the ink.

6 Claims, 5 Drawing Sheets

STENCIL PRINTING INK CONTAINER

BACKGROUND OF THE INVENTION

1. Field of the Invention

This invention relates to a stencil printing ink container, which is capable of being releasably fitted to a stencil printing apparatus in order to furnish ink to the stencil printing apparatus.

2. Description of the Related Art

Stencil printing apparatuses for performing printing operations by use of thermosensible stencil paper have heretofore been known. With the stencil printing apparatuses, a thermal head comprising fine heating elements arrayed in a line is brought into contact with stencil paper, and the stencil paper is conveyed by a platen roller, or the like, while the heating elements are being energized. In this manner, a perforation image in accordance with image information is formed on the stencil paper. Thereafter, the stencil paper, on which the perforation image has been formed, is wound around a printing drum. Also, printing paper is pushed by a pushing member, such as a press roller, against an outer circumferential surface of the drum and moved. In this manner, ink is oozed out through an opening area of the drum and perforations of the stencil paper and transferred onto the printing paper. A printed image is thus formed on the printing paper.

In order to cope with reduction in diameter of plate making perforations of the stencil paper for obtaining a precise printed image, or in order to enhance the printing speed by enhancing infiltrating characteristics of the ink into the printing paper, it is often desired that a viscosity of the ink used be set at a low viscosity. In particular, in cases where the ink viscosity with respect to a region of a shear rate of at most 100 $sec^{-1}$ is set at a low viscosity, the ink having been transferred onto the printing paper is capable of quickly infiltrating into the printing paper, and printed paper free from an ink offset to the back of the paper is capable of being obtained.

Conventional ink furnishing means of the stencil printing apparatuses comprises an ink furnishing roller, a distributor, and a doctor roller. The ink furnishing roller is located within the printing drum and is supported between side plates which stand facing each other. The ink furnishing roller is capable of rotating around its center axis. The distributor is located on the ink furnishing roller and supplies the ink onto the ink furnishing roller. The doctor roller is located at a predetermined spacing from the ink furnishing roller and controls the thickness of an ink film, which is formed around the outer circumferential surface of the ink furnishing roller. An example of the distributor comprises parallel tubular members having a plurality of holes having a small diameter. A different example of the distributor comprises a plurality of nozzles. The ink is sucked by an ink pump from an ink container and supplied dropwise through the distributor onto the ink furnishing roller. An ink accumulating area is formed at a wedge-shaped region between the ink furnishing roller and the doctor roller. The ink is furnished through a space between the ink furnishing roller and the doctor roller into the printing drum. Such that the ink may be furnished uniformly, a predetermined amount of the ink is always held at the ink accumulating area.

Ordinarily, a W/O type of emulsion ink comprising 10 wt % to 50 wt % of an oil phase and 90 wt % to 50 wt % of an aqueous phase is utilized for the stencil printing apparatuses. In cases where the stencil printing apparatuses are left to stand for a long period of time instead of being used for the printing, since the ink accumulated at the ink accumulating area is exposed to air, water contained in the ink is vaporized, and a pigment concentration in the ink becomes high. Therefore, the ink having a low viscosity remains at the ink accumulating area. In cases where fresh ink is furnished to the ink accumulating area, the remaining ink and the fresh ink cannot easily mix with each other, and therefore it often occurs that nonuniformity in image density occurs on the printed paper. Nonuniformity in image density occurs markedly in the cases of ink, which has a comparatively high viscosity with respect to the region of the shear rate of at most 100 $sec^{-1}$.

As an example of an ink container utilized for the stencil printing apparatuses, there has heretofore been known an ink container (a BIC type of an ink container) comprising an outside casing formed from a corrugated board, or the like, and a flexible inside bag accommodated within the outside casing. An ink injecting tube, which is formed at an end of the inside bag, is projected from the region within the outside casing to the exterior of the outside casing, and the projected end of the ink injecting tube is closed with a cap. Also, as a different example of an ink container utilized for the stencil printing apparatuses, there has heretofore been known an ink container (a piston type of an ink container) comprising a cylinder, which has a circular cylinder-like shape and is provided with an ink discharge opening section at an end, and a piston, which is located within the cylinder. In particular, the piston type of the ink container has the advantages in that the amount of the ink, which remains within the ink container after the ink suction has been performed until ink suction and furnishing cannot be conducted any more, is smaller than 8 the amount of the remaining ink in the cases of the BIC type of the ink container, and therefore the ink is capable of being used efficiently. The ink discharge opening section of the piston type of the ink container is sealed by a thread type of cap. When the piston type of the ink container is to be used, the user removes the cap from the ink discharge opening section, inserts the ink container through a container holder on the side of the main body of the stencil printing apparatus, and fits the ink discharge opening section of the ink container to an ink suction opening section on the side of the main body of the stencil printing apparatus. In this manner, the piston type of the ink container is used.

However, with the conventional piston type of the ink container, it is considered that the problems described below occurs in cases where the ink container is filled with ink having a comparatively low viscosity with respect to the region of the low shear rate described above and used. Specifically, in cases where the user removes the cap from the ink discharge opening section of the ink container and holds the ink container with the ink discharge opening section facing down, the ink drips down from the ink discharge opening section of the ink container and soils the hands or clothes of the user, the region within the stencil printing apparatus, a floor surface within a room in which the stencil printing apparatus is located, or the like.

In order for the problems described above to be solved, a structure, in which a valve opened through engagement with a main body of a printing machine is located within an ink discharge opening section of an ink container, has been proposed in, for example, Japanese Unexamined Patent Publication No. 2000-318288. However, the proposed ink container has the problems in that the valve located within the ink discharge opening section of the ink container is constituted of a fine member and therefore has a strong probability of being broken, and in that the cost cannot be kept low due to the increased number of parts.

Also, a method of setting an ink container, wherein an ink container is set in a main body of a printing machine with an ink discharge opening section of the ink container facing up, such that a user may not locate the ink container with the ink discharge opening section facing down in a state in which the ink discharge opening section is released, has been proposed in, for example, Japanese Unexamined Patent Publication No. 2000-272097. However, with the proposed method of setting an ink container, limitation is imposed upon the size of the ink container which is capable of being utilized. However, stencil printing apparatuses are used primarily in applications in which a large number of prints are formed from a single stencil paper. Therefore, the ink containers for use in the stencil printing apparatuses are designed with the intention of quickly furnishing a larger amount of ink than in the cases of ordinary business equipment, and the sizes of the ink containers are set to be comparatively large such that the amount of the ink loaded into a single ink container may fall within the range of 500 ml to 1,500 ml. Accordingly, with the proposed method of setting an ink container, the setting of the ink containers in the stencil printing apparatuses cannot be performed satisfactorily unless the diameter and the length of the drum are set at markedly large values.

SUMMARY OF THE INVENTION

The primary object of the present invention is to provide a stencil printing ink container, which is free from problems in that, in cases where ink having a low viscosity is accommodated within the ink container, the ink drips down from an ink discharge opening section of the ink container at the time of setting of the ink container into a stencil printing apparatus and at the time of removal of the ink container from the stencil printing apparatus.

The present invention provides a stencil printing ink container, comprising:

i) a cylinder having an approximately circular cylinder-like shape, an area of one end of the cylinder, which area is other than an ink discharge opening section, being closed with an end wall, the other end of the cylinder being open, and ii) a piston, which is capable of undergoing a sliding movement in an axial direction of the cylinder and along an inner circumferential surface of the cylinder, the stencil printing ink container being filled with ink, which has a viscosity of at most 7.5Pa·s with respect to a shear rate of 100 $sec^{-1}$ and at a temperature of 23° C., and satisfying relationship represented by the formula:

$$r \leqq \left(\frac{3.0\times10^{-6}\cdot 8\eta\cdot L\cdot R^2}{9.8\left(\sqrt{1/\eta}\cdot W-N\right)}\right)^{1/4} \quad \text{or} \quad 0 \geqq \sqrt{1/\eta}\cdot W-N$$

wherein R represents the inside radius, in units of m, of the cylinder, r represents the inside radius, in units of m, of the ink discharge opening section, L represents the length, in units of m, of the ink discharge opening section, W represents the weight, in units of kg, of the ink filled in the stencil printing ink container, N represents the sliding movement starting load, in units of kgf, of the piston, and η represents the viscosity, in units of Pa·s, of the ink, which is filled in the stencil printing ink container, with respect to a shear rate of 100 $sec^{-1}$ and at a temperature of 23° C.

In the stencil printing ink container in accordance with the present invention, the viscosity of the ink is the viscosity with respect to a shear rate of 100 $sec^{-1}$ and at a temperature of 23° C. Unless otherwise specified, the term "viscosity of ink" as used herein means the viscosity with respect to a shear rate of 100 $sec^{-1}$ and at a temperature of 23° C.

The stencil printing ink container in accordance with the present invention should preferably be modified such that the ink discharge opening section is provided with a conical tapered area.

Also, the stencil printing ink container in accordance with the present invention should preferably be modified such that a position of the ink discharge opening section is shifted outwardly from a center point of the one end of the cylinder. Further, in such cases, the stencil printing ink container in accordance with the present invention should more preferably be modified such that the stencil printing ink container is used in a stencil printing apparatus, in which the stencil printing ink container is set horizontally to an ink suction opening section of the stencil printing apparatus with the ink discharge opening section being positioned more upward than the center point of the one end of the cylinder.

Furthermore, the stencil printing ink container in accordance with the present invention should preferably be modified such that the ink discharge opening section is cut obliquely. Also, in such cases, the stencil printing ink container in accordance with the present invention should more preferably be modified such that the stencil printing ink container is used in a stencil printing apparatus, in which the stencil printing ink container is set horizontally to an ink suction opening section of the stencil printing apparatus with the end of the ink discharge opening section facing upward. The expression of "an end of an ink discharge opening section facing upward" as used herein means that the stencil printing ink container is positioned such that the obliquely cut area of the ink discharge opening section stands facing upward.

The stencil printing ink container in accordance with the present invention comprises the cylinder having the approximately circular cylinder-like shape, the area of one end of the cylinder, which area is other than the ink discharge opening section, being closed with the end wall, the other end of the cylinder being open. The stencil printing ink container in accordance with the present invention also comprises the piston, which is capable of undergoing the sliding movement in the axial direction of the cylinder and along the inner circumferential surface of the cylinder. Further, the stencil printing ink container is filled with ink, which has a viscosity of at most 7.5 Pa·s with respect to a shear rate of 100 $sec^{-1}$ and at a temperature of 23° C. Furthermore, the stencil printing ink container satisfies the relationship represented by the formula:

$$r \leqq \left(\frac{3.0\times10^{-6}\cdot 8\eta\cdot L\cdot R^2}{9.8\left(\sqrt{1/\eta}\cdot W-N\right)}\right)^{1/4} \quad \text{or} \quad 0 \geqq \sqrt{1/\eta}\cdot W-N$$

wherein R represents the inside radius, in units of m, of the cylinder, r represents the inside radius, in units of m, of the ink discharge opening section, L represents the length, in units of m, of the ink discharge opening section, W represents the weight, in units of kg, of the ink filled in the stencil printing ink container, N represents the sliding movement starting load, in units of kgf, of the piston, and η represents the viscosity, in units of Pa·s, of the ink, which is filled in the stencil printing ink container, with respect to a shear rate of 100 $sec^{-1}$ and at a temperature of 23° C.

Therefore, with the stencil printing ink container in accordance with the present invention, the problems are capable of being prevented from occurring in that, in cases where ink having a low viscosity with respect to a region of a low shear rate is accommodated within the ink container, the ink drips down from the ink discharge opening section of the ink container when the ink discharge opening section of the ink container is positioned so as to stand facing down at the time of the setting of the ink container into the stencil printing apparatus.

With the stencil printing ink container in accordance with the present invention, wherein the ink discharge opening section of the ink container is provided with the conical tapered area, the ink flowing out from the ink container is capable of being temporarily retained at the conical tapered area. Therefore, the dripping of the ink from the ink discharge opening section is capable of being restricted for a long time.

The stencil printing ink container in accordance with the present invention may be modified such that the position of the ink discharge opening section is shifted outwardly from the center point of the one end of the cylinder, and the stencil printing ink container is used in the stencil printing apparatus, in which the stencil printing ink container is set horizontally to the ink suction opening section of the stencil printing apparatus with the ink discharge opening section being positioned more upward than the center point of the one end of the cylinder. In such cases, the pressure of the ink exerted upon the ink discharge opening section of the ink container is capable of being kept low. Therefore, the dripping of the ink from the ink discharge opening section is capable of being restricted more efficiently.

Also, the stencil printing ink container in accordance with the present invention may be modified such that the ink discharge opening section is cut obliquely, and the stencil printing ink container is used in the stencil printing apparatus, in which the stencil printing ink container is set horizontally to the ink suction opening section of the stencil printing apparatus with the end of the ink discharge opening section facing upward. In such cases, since the oblique cut area of the ink discharge opening section is positioned so as to stand facing upward, the dripping of the ink from the ink discharge opening section is capable of being restricted more efficiently.

DESCRIPTION OF THE PREFERRED EMBODIMENTS

The present invention will hereinbelow be described in further detail with reference to the accompanying drawings.

Figure 1:
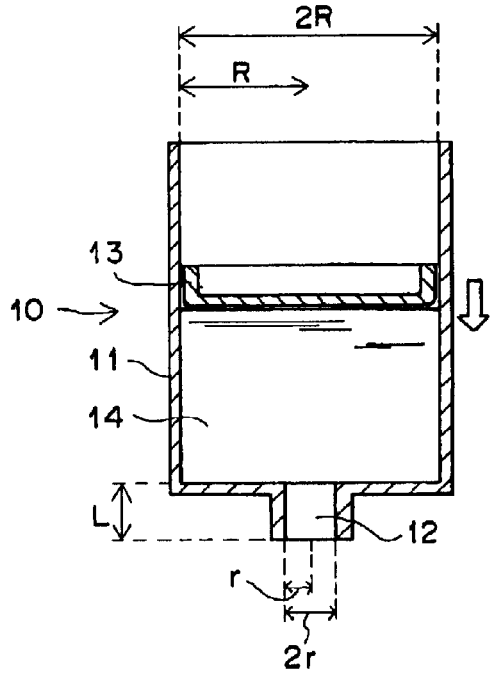
FIG. 1 is a schematic explanatory view showing a first embodiment of the stencil printing ink container in accordance with the present invention, which has been filled with ink.

FIG. 1 is a schematic explanatory view showing a first embodiment of the stencil printing ink container in accordance with the present invention, which has been filled with ink.

With reference to FIG. 1, a stencil printing ink container 10, which is a first embodiment of the stencil printing ink container in accordance with the present invention, comprises a cylinder 11 provided with an ink discharge opening section 12 at one end. The cylinder 11 has an approximately circular cylinder-like shape. The area of the one end of the cylinder 11, which area is other than the ink discharge opening section 12, is closed with an end wall. The other end of the cylinder 11 is open. The stencil printing ink container 10 also comprises a piston 13, which is capable of undergoing a sliding movement in an axial direction of the cylinder 11 and along an inner circumferential surface of the cylinder 11. Further, the stencil printing ink container 10 is filled with ink 14, which has a viscosity of at most 7.5 Pa·s. Furthermore, the stencil printing ink container 10 satisfies the relationship represented by the formula:

$$r \leqq \left(\frac{3.0\times10^{-6}\cdot 8\eta\cdot L\cdot R^2}{9.8\left(\sqrt{1/\eta}\cdot W-N\right)}\right)^{1/4} \quad \text{or} \quad 0 \geqq \sqrt{1/\eta}\cdot W-N$$

wherein R represents the inside radius, in units of m, of the cylinder 11, r represents the inside radius, in units of m, of the ink discharge opening section 12, L represents the length, in units of m, of the ink discharge opening section 12, W represents the weight, in units of kg, of the ink 14 filled in the stencil printing ink container 10, N represents the sliding movement starting load, in units of kgf, of the piston 13, and η represents the viscosity, in units of Pa·s, of the ink 14, which is filled in the stencil printing ink container 10.

Figure 2:
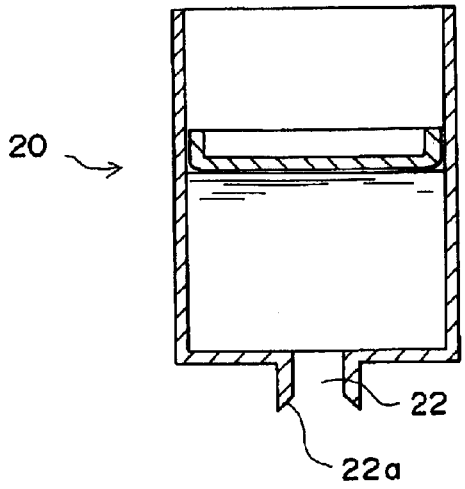
FIG. 2 is a schematic explanatory view showing a second embodiment of the stencil printing ink container in accordance with the present invention.

FIG. 2 is a schematic explanatory view showing a second embodiment of the stencil printing ink container in accordance with the present invention. As illustrated in FIG. 2, with a stencil printing ink container 20, which is a second embodiment of the stencil printing ink container in accordance with the present invention, a conical tapered area 22*a* is formed in the inside of the end of an ink discharge opening section 22 of the stencil printing ink container 20. In cases where the ink discharge opening section 22 of the stencil printing ink container 20 is thus provided with the conical tapered area 22*a*, the ink flowing out from the stencil printing ink container 20 is capable of being temporarily retained at the conical tapered area 22*a*. Therefore, the dripping of the ink from the ink discharge opening section 22 is capable of being restricted for a long time.

Figure 3:
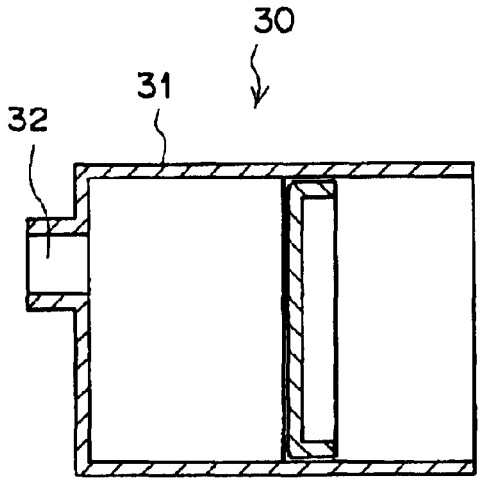
FIG. 3 is a schematic explanatory view showing a third embodiment of the stencil printing ink container in accordance with the present invention.

FIG. 3 is a schematic explanatory view showing a third embodiment of the stencil printing ink container in accordance with the present invention. As illustrated in FIG. 3, with a stencil printing ink container 30, which is a third embodiment of the stencil printing ink container in accordance with the present invention, the position of an ink discharge opening section 32 of the stencil printing ink container 30 is shifted outwardly from the center point of one end of a cylinder 31. In cases where the stencil printing ink container 30 is used in a stencil printing apparatus, in which the stencil printing ink container 30 is set horizontally to an ink suction opening section of the stencil printing apparatus with the ink discharge opening section 32 being positioned more upward than the center point of the one end of the cylinder 31, the dripping of the ink from the ink discharge opening section 32 is capable of being restricted more efficiently.

Figure 4:
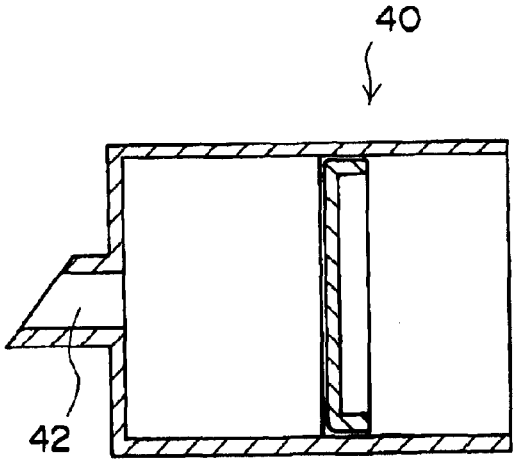
FIG. 4 is a schematic explanatory view showing a fourth embodiment of the stencil printing ink container in accordance with the present invention.

FIG. 4 is a schematic explanatory view showing a fourth embodiment of the stencil printing ink container in accordance with the present invention. As illustrated in FIG. 4, with a stencil printing ink container 40, which is a fourth embodiment of the stencil printing ink container in accordance with the present invention, the end of an ink discharge opening section 42 of the stencil printing ink container 40 is cut obliquely. In cases where the stencil printing ink container 40 is used in a stencil printing apparatus, in which the stencil printing ink container 40 is set horizontally to an ink suction opening section of the stencil printing apparatus with the obliquely cut end of the ink discharge opening section 42 facing upward as illustrated in FIG. 4, since the oblique cut area of the ink discharge opening section 42 is positioned so as to stand facing upward, the dripping of the ink from the ink discharge opening section 42 is capable of being restricted more efficiently.

The present invention will further be illustrated by the following nonlimitative examples.

EXAMPLES

Preparation of Ink Samples Having Different Viscosities

Each of three kinds of stencil printing emulsion ink samples were prepared in the manner described below by employing the compositions listed in Table 1 below. Specifically, firstly, an alkyd resin (oil length: 65, weight-average molecular weight: approximately 10,000, acid value: 5, hydroxyl value: 50), carbon black (MA-100, supplied by Mitsubishi Chemical Corporation), a volatile solvent (AF-6, supplied by Nippon Oil Corporation), and a surface-active agent (sorbitan monooleate) were mixed and stirred intimately. The resulting mixture was then kneaded sufficiently with a three-roll mill. Thereafter, a non-volatile solvent (Sunthene 4240, supplied by Japan Sun Oil Co., Ltd.) and a volatile solvent (Exxole D80, supplied by Exxon Chemical Japan, Ltd.) were added to the kneaded mixture described above. In this manner, an oil phase was prepared. Thereafter, an aqueous phase containing distilled water, a humectant (ethylene glycol), and an electrolyte (magnesium sulfate) was added little by little with stirring to the oil phase and emulsified. In this manner, each of the stencil printing emulsion ink samples was prepared.

TABLE 1

| W/O emulsion ink composition (parts by weight) | | | Ink sample 1 | Ink sample 2 | Ink sample 3 |
|---|---|---|---|---|---|
| Oil phase | Carbon black | MA-100 | 7.0 | 7.0 | 7.0 |
| | Non-volatile solvent | Sunthene 4240 | 2.0 | 2.0 | 2.0 |
| | Volatile solvent | Exxole D80 | 3.0 | 3.0 | 3.0 |
| | | AF-6 | 15.0 | 11.0 | 9.0 |
| | Resin | Alkyd resin | 6.0 | 10.0 | 12.0 |
| | Surface-active agent | Sorbitan monooleate | 2.0 | 2.0 | 2.0 |
| Aqueous phase | Distilled | | 58.0 | 58.0 | 58.0 |
| | Humectant | Ethylene glycol | 6.5 | 6.5 | 6.5 |
| | Electrolyte | Magnesium sulfate | 0.5 | 0.5 | 0.5 |
| Measured value of ink viscosity (Pa · s) | | | 3.2 | 5.3 | 7.4 |

The measured value of ink viscosity shown in Table 1 was obtained by using a stress control type of rheometer (Rheostress RS75, supplied by HAAKE Company). Specifically, a cone having a diameter of 20 mm and a cone angle of 1° was used, stress was raised from 0 Pa at a rate of 20 Pa per second and at a temperature of 23° C., and the viscosity was measured with respect to a shear rate of 100 $sec^{-1}$.

Preparation of Ink Containers

Four kinds of ink containers were prepared in the manner described below. Specifically, piston types of ink containers, which had a length 270 mm, a cylinder outside diameter of 79.5 mm, a cylinder inside diameter of 76.5 mm, an inside diameter of an ink discharge opening section of 19 mm, and a length of the ink discharge opening section of 15.5 mm, and which were made from polypropylene, were prepared. Also, four kinds of pistons having different outside diameters were combined with the cylinder described above. In this manner, the four kinds of the ink containers having different sliding movement starting loads of pistons were prepared.

The measurement of the sliding movement starting load of the piston was performed by using SHIMADZU AGS-500D (LOAD CELL: SBL-5KN). Specifically, with the piston type of the ink container, in which no ink had been filled, the sliding movement starting load of the piston, at which the piston began moving from a stationary state, was measured. The movement speed was set at 100 mm/min.

Also, in order for the ink discharge opening section to be adjusted, four kinds of adapters were prepared by performing boring processing on polypropylene members, which were capable of fitting to the piston container having the inside diameter of the ink discharge opening section of 19 mm and were made from the same material as the material of the piston container. With the boring processing, holes having diameters of 4 mm, 8 mm, 12 mm, and 16 mm were formed respectively at the center areas of the polypropylene members. In this manner, the four kinds of the adapters were prepared.

Twenty kinds of ink containers were prepared from combinations of the aforesaid four kinds of the containers exhibiting the different sliding movement starting loads of the pistons and the five kinds of the ink discharge opening section adjusting members having the different inside diameters of the ink discharge opening sections.

Ink Filling into Ink Containers and Evaluation

Each of the three kinds of the ink samples having the different viscosities was filled in each of the 20 kinds of the ink containers. An ink portion, which was present at the ink discharge opening section (specifically, at the section extending by a length of 15.5 mm from the end of the ink discharge opening section), was then removed. The ink container having been filled with the ink was then located with the ink discharge opening section facing downward and was left to stand for 20 seconds in this state. Thereafter, the state of ink dripping from the ink discharge opening section was evaluated. The length of time, for which the ink container was left to stand, was thus set at 20 seconds for the reasons described below. Specifically, ordinarily, exchange of the ink container is performed with the procedure, wherein a front cover of a printing apparatus is opened, the ink container having been used is pulled out from the printing apparatus, a cap having been fitted to an ink discharge opening section of a new ink container is removed from the ink discharge opening section of the new ink container, and the new ink container is fitted to the printing apparatus. Therefore, it is considered that the risk of the ink dripping from the ink discharge opening section of the ink container with the ink discharge opening section of the ink container facing downward occurs during the time between when the cap is removed from the new ink container and when the new ink container is fitted to the printing apparatus. The time between when the cap is removed from the new ink container and when the new ink container is fitted to the printing apparatus is considered to be at most approximately 10 seconds. Therefore, in the experiments, the use of the ink container by unskilled users was assumed, and the length of time, for which the ink container was left to stand, was set at 20 seconds.

Figure 5A:
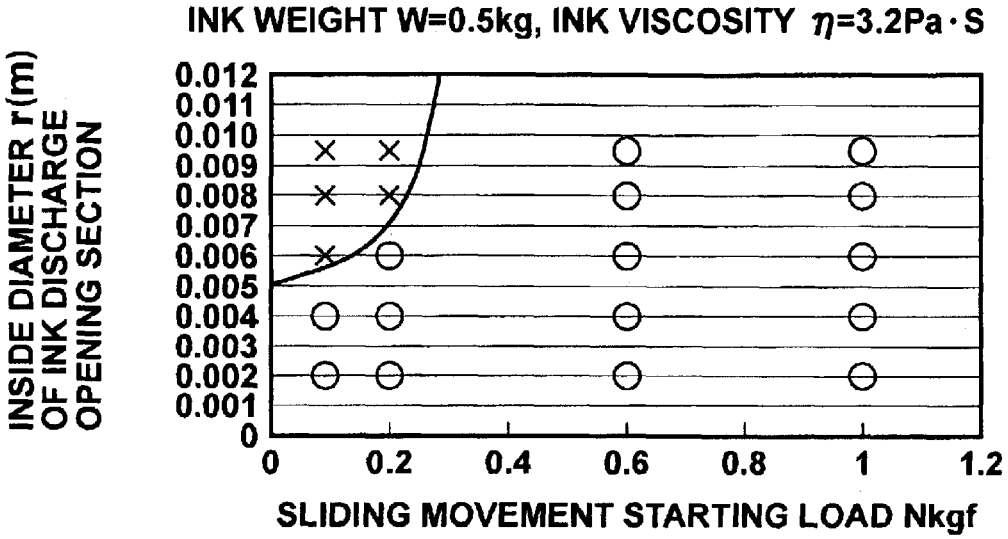
FIG. 5A is a graph showing relationship between ink having a viscosity of 3.2 Pa·s and ink containers, which relationship is obtained when a weight of the ink filled in each of the ink containers is 500 g.
Figure 5B:
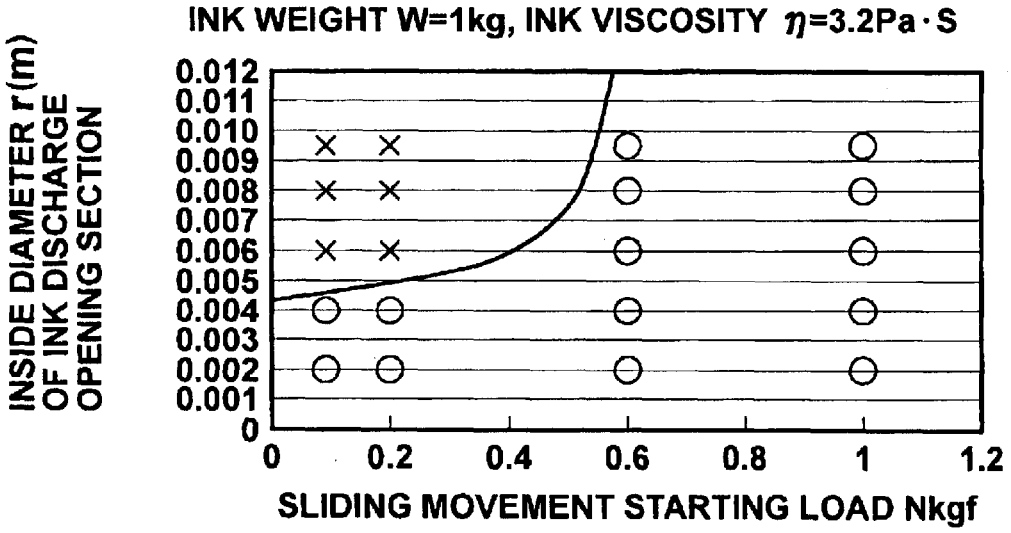
FIG. 5B is a graph showing relationship between the ink having a viscosity of 3.2 Pa·s and the ink containers, which relationship is obtained when the weight of the ink filled in each of the ink containers is 1,000 g.
Figure 6A:
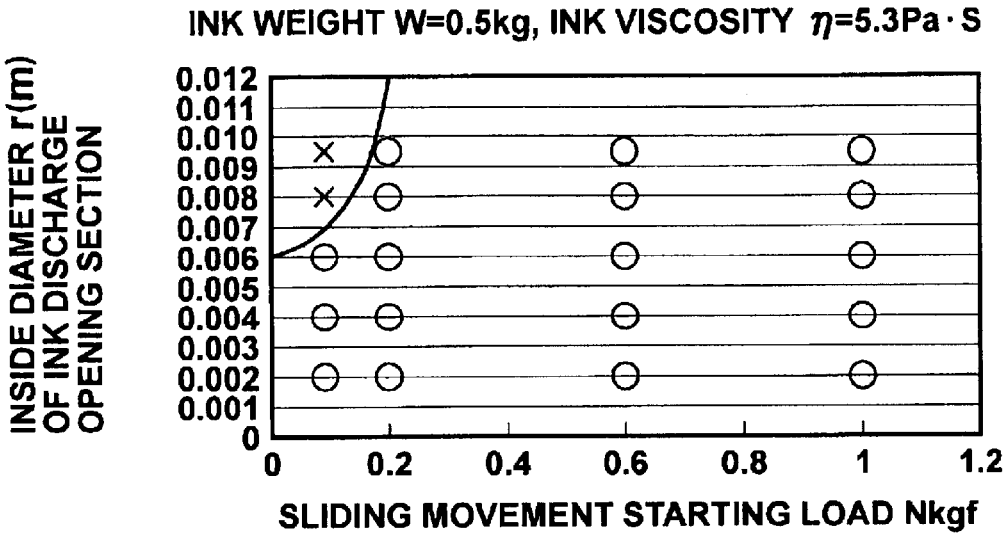
FIG. 6A is a graph showing relationship between ink having a viscosity of 5.3 Pa·s and the ink containers, which relationship is obtained when the weight of the ink filled in each of the ink containers is 500 g.
Figure 6B:
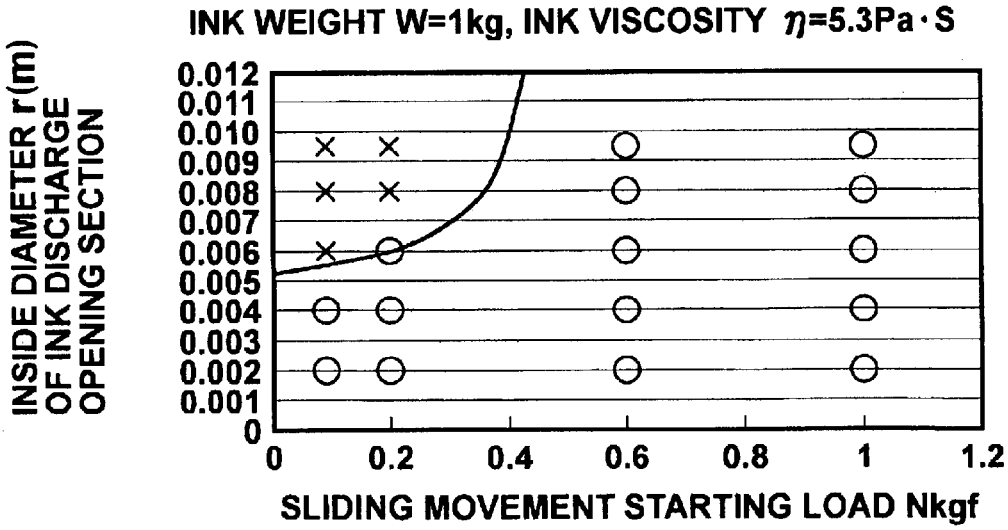
FIG. 6B is a graph showing relationship between the ink having a viscosity of 5.3 Pa·s and the ink containers, which relationship is obtained when the weight of the ink filled in each of the ink containers is 1,000 g.
Figure 7A:
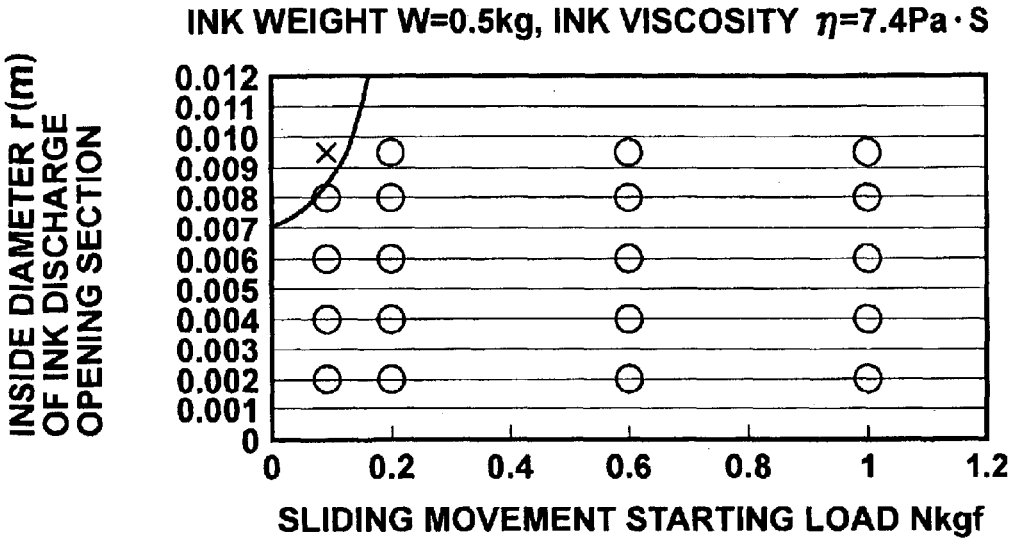
FIG. 7A is a graph showing relationship between ink having a viscosity of 7.4 Pa·s and the ink containers, which relationship is obtained when the weight of the ink filled in each of the ink containers is 500 g.
Figure 7B:
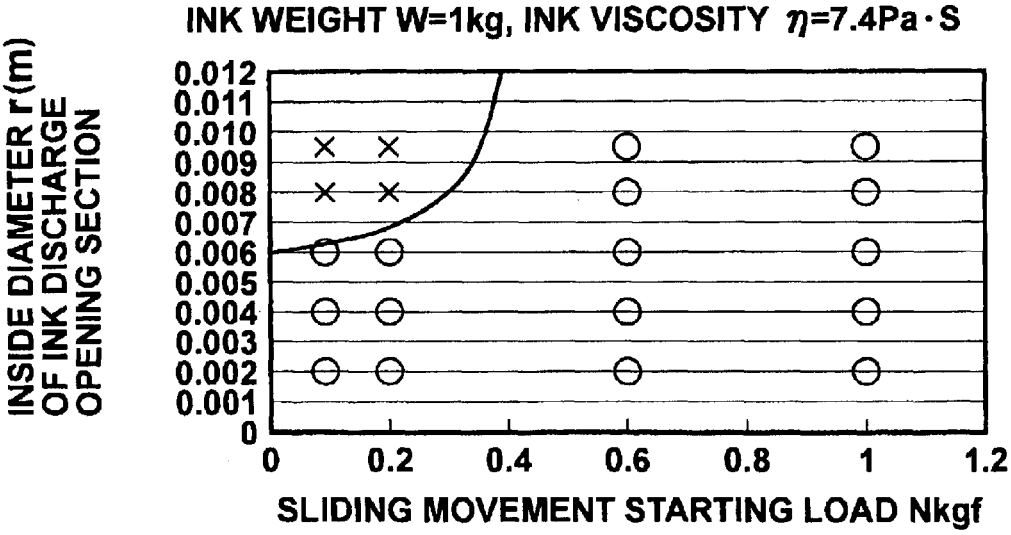
FIG. 7B is a graph showing relationship between the ink having a viscosity of 7.4 Pa·s and the ink containers, which relationship is obtained when the weight of the ink filled in each of the ink containers is 1,000 g.

Results shown in graphs of FIGS. 5A, 5B, FIGS. 6A, 6B, and FIGS. 7A, 7B were obtained. FIG. 5A is a graph showing relationship between an ink sample 1 listed in Table 1 and the ink containers, which relationship is obtained when the weight of the ink filled in each of the ink containers is 500 g. FIG. 5B is a graph showing relationship between the ink sample 1 listed in Table 1 and the ink containers, which relationship is obtained when the weight of the ink filled in each of the ink containers is 1,000 g. FIG. 6A is a graph showing relationship between an ink sample 2 listed in Table 1 and the ink containers, which relationship is obtained when the weight of the ink filled in each of the ink containers is 500 g. FIG. 6B is a graph showing relationship between the ink sample 2 listed in Table 1 and the ink containers, which relationship is obtained when the weight of the ink filled in each of the ink containers is 1,000 g. FIG. 7A is a graph showing relationship between an ink sample 3 listed in Table 1 and the ink containers, which relationship is obtained when the weight of the ink filled in each of the ink containers is 500 g. FIG. 7B is a graph showing relationship between the ink sample 3 listed in Table 1 and the ink containers, which relationship is obtained when the weight of the ink filled in each of the ink containers is 1,000 g. Also, in each of the graphs, the mark "○" represents that ink dripping from the ink discharge opening section did not occur when the ink container was left to stand for 20 seconds in the manner described above, and the mark "x" represents that ink dripping from the ink discharge opening section occurred when the ink container was left to stand for 20 seconds in the manner described above. Further, in each of the graphs, the solid line represents the state, in which the value of r is equal to the value of the right-hand side in the following relation:

$$r \leqq \left(\frac{3.0\times10^{-6}\cdot 8\eta\cdot L\cdot R^2}{9.8\left(\sqrt{1/\eta}\cdot W-N\right)}\right)^{1/4}$$

wherein R represents the inside radius, in units of m, of the cylinder, r represents the inside radius, in units of m, of the ink discharge opening section, L represents the length, in units of m, of the ink discharge opening section, W represents the weight, in units of kg, of the ink filled in the stencil printing ink container, N represents the sliding movement starting load, in units of kgf, of the piston, and η represents the viscosity, in units of Pa·s, of the ink.

As clear from the graphs of FIGS. 5A, 5B, FIGS. 6A, 6B, and FIGS. 7A, 7B, the stencil printing ink container in accordance with the present invention satisfies the relationship represented by the following formula:

$$r \leqq \left(\frac{3.0\times10^{-6}\cdot 8\eta\cdot L\cdot R^2}{9.8\left(\sqrt{1/\eta}\cdot W-N\right)}\right)^{1/4} \quad \text{or} \quad 0 \geqq \sqrt{1/\eta}\cdot W-N$$

wherein R represents the inside radius, in units of m, of the cylinder, r represents the inside radius, in units of m, of the ink discharge opening section, L represents the length, in units of m, of the ink discharge opening section, W represents the weight, in units of kg, of the ink filled in the stencil printing ink container, N represents the sliding movement starting load, in units of kgf, of the piston, and η represents the viscosity, in units of Pa·s, of the ink.

Therefore, with the stencil printing ink container in accordance with the present invention, the problems are capable of being prevented from occurring in that, in cases where the ink having a low viscosity with respect to a region of a low shear rate is accommodated within the ink container, the ink drips down from the ink discharge opening section of the ink container at the time of the setting of the ink container into the stencil printing apparatus and at the time of removal of the ink container from the stencil printing apparatus.

In the examples described above, the W/O types of emulsion ink samples were employed. However, no limitation is imposed upon the ink for use in the stencil printing ink container in accordance with the present invention, and the ink may be selected from a wide variety of kinds of ink, which have a viscosity of at most 7.5Pa·s with respect to a shear rate of 100 $sec^{-1}$ and at a temperature of 23° C.

What is claimed is:

1. A stencil printing ink container, comprising:

i) a cylinder having an substantially circular cylinder-like shape, the cylinder further comprising a first end having a wall and an ink discharge opening and a second end that is open; and ii) a piston, capable of sliding in an axial direction of the cylinder and along an inner circumferential surface of the cylinder, wherein the stencil printing ink container can be filled with ink, having a viscosity of at most 7.5 Pa·s, with respect to a shear rate of 100 $sec^{-1}$ and at a temperature of 23° C., and satisfying at least one of the following relationships:

$$r \leq \left\{ \frac{3.0 \times 10^{-6} \cdot 8\eta \cdot L \cdot R^2}{9.8((1/\eta)^{1/2} \cdot W - N)} \right\}^{1/4} \text{ where } (1/\eta)^{1/2} \cdot W - N > 0;$$

$$\text{and } 0 \geq (1/\eta)^{1/2} \cdot W - N, \text{ where}$$

R is an inside radius, in units of m, of the cylinder, r is an inside radius, in units of m, of the ink discharge opening section, L is a length, in units of m, of the ink discharge opening section, W is a weight, in units of kg, of the ink filled in the stencil printing ink container, N is a sliding movement starting load, in units of kg f, of the piston, and η is a viscosity, in units of Pa·s, of the ink, which is filled in the stencil printing ink container, with respect to a shear rate of 100 $sec^{-1}$ and at a temperature of 23° C.

2. The stencil printing ink container of claim 1, wherein the ink discharge opening includes a conical tapered area.

3. The stencil printing ink container of claim 1, wherein a position of the ink discharge opening section is shifted outwardly from a center point of the one end of the cylinder.

4. A stencil printing ink container of claim 3, wherein the stencil printing ink container is used in a stencil printing apparatus and the stencil printing ink container is positioned horizontally to accommodate an ink suction opening section of the stencil printing apparatus with the ink discharge opening section being located at a point above the center point of the one end of the cylinder.

5. A stencil printing ink container of claim 1, wherein the ink discharge opening section is cut obliquely.

6. A stencil printing ink container of claim 5, wherein the stencil printing ink container is used in a stencil printing apparatus and the stencil printing ink container is positioned horizontally to accommodate an ink suction opening section of the stencil printing apparatus with the end of the ink discharge opening section facing upward.

* * * * *